United States Patent [19]

Akamatsu

[11] Patent Number: 4,978,996

[45] Date of Patent: Dec. 18, 1990

[54] ERASER TURN-ON CONTROL FOR A COPIER

[75] Inventor: Hiroyuki Akamatsu, Yamato, Japan

[73] Assignee: Ricoh Company, Ltd., Tokyo, Japan

[21] Appl. No.: 396,827

[22] Filed: Aug. 21, 1989

Related U.S. Application Data

[63] Continuation of Ser. No. 191,251, May 6, 1988, abandoned.

[30] Foreign Application Priority Data

May 6, 1987 [JP] Japan ..... 62-108833

[51] Int. Cl.[5] ..... G03G 21/00

[52] U.S. Cl. ..... 355/231; 355/75; 355/218

[58] Field of Search ..... 355/230, 231, 75, 218, 355/208

[56] References Cited

U.S. PATENT DOCUMENTS

| | | | |
|---|---|---|---|
| 3,834,807 | 9/1974 | Fuller et al. | 355/3 R |
| 4,505,575 | 3/1985 | Palumbo | 355/75 X |
| 4,659,214 | 4/1987 | Takemura et al. | 355/75 |
| 4,695,154 | 9/1987 | Watanabe | 355/3 R X |
| 4,728,985 | 3/1988 | Nakashima et al. | 355/7 |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

An erasure turn-on control device applicable to a copier of the type which erases before developing a needless charge deposited in an area of a photoconductive element other than an image area. The erasure turn-on control is automatically switched depending upon the position of a cover plate, i.e., an open or a closed position.

3 Claims, 8 Drawing Sheets

ERASER TURN-ON CONTROL FOR A COPIER

This application is a continuation of application Ser. No. 07/191,251, filed on May 6, 1988, now abandoned.

BACKGROUND OF THE INVENTION

The present invention relates to a device for controlling the turn-on of an eraser of a copier and, more particularly, to an eraser turn-on control device for a copier of the type which erases before developing a needless charge deposited in the area of a photoconductive element other than an image area.

In a copier of the type described, it has been customary to prevent edges (lines) of an original document from being reproduced by turning on an eraser as far as those positions which are slightly inwardly of the edges of the document. On the other hand, there is an increasing demand for a capability of copying the entire surface of an original document without leaving any blank on a copy. Such full-surface copying is implemented by limiting the turn-on range of an eraser to 2 to 3 millimeters outside of the edges of a document. A problem with this kind of scheme is that even the outside of a document size is imaged on a photoconductive element and, in addition, it is located outside of a transfer region. This is not a problem so long as a cover plate is closed because the underside of the cover plate (which is usually colored in white or substantially white) is imaged. However, when the cover plate is open, light issuing from an illuminating unit fails to be reflected and therefore forms a black portion on a photoconductive element, resulting in wasteful consumption of toner. Further, since such a black portion is moved to a cleaning unit without being transferred to a paper, the cleaning unit has to be provided with a considerable cleaning ability. When toner remaining on the photoconductive element after image transfer is not completely removed, it appears on the subsequent copies as a smear.

SUMMARY OF THE INVENTION

It is therefore an object of the present invention to provide an eraser turn-on control device for a copier which automatically switches erasure turn-on control to eliminate wasteful consumption of toner while freeing a cleaning unit from an excessive load.

It is another object of the present invention to provide a generally improved eraser turn-on control device for a copier.

An erasure turn-on control device for a copier which includes a photoconductive element and a cover plate for pressing an original document which is laid on a glass platen of the present invention comprises an eraser for removing after charging or imagewise exposure a charge which is deposited on a non-image area of the photoconductive element, a switch for sensing an open and a closed position of the cover plate, and control means responsive to an output of the switch for automatically switching turn-on control of the eraser depending upon a position of the cover plate.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
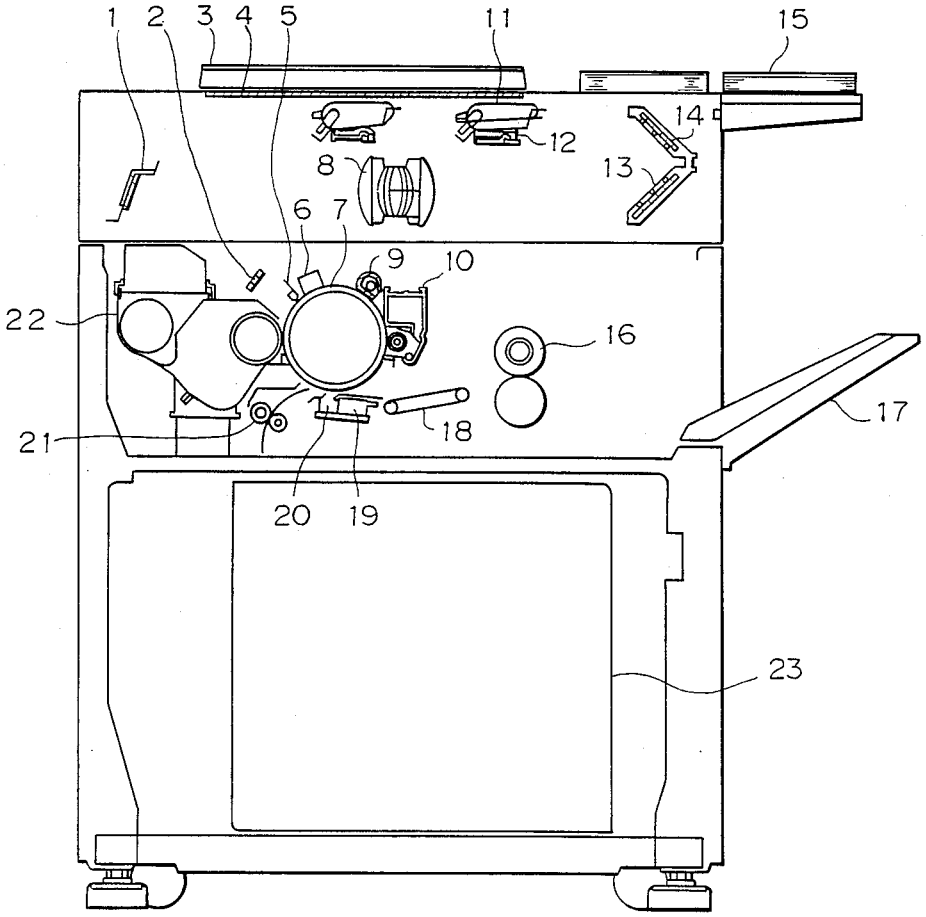
FIG. 1 is a schematic view showing a copier to which the present invention is applied.

Referring to FIG. 1 of the drawings, a copier to which the present invention is applied is shown. As shown, the copier includes a fourth mirror 1, a cover plate 3, a glass platen 4, a charger 6, a photoconductive drum 7, a lens 8, a discharging lamp 9, a cleaning unit 10, an illuminating unit 11, a first mirror 12, a third mirror 13, a second mirror 14, a document tray 15, a fixing section 16, a copy tray 17, a belt 18, a separation charger 19, a transfer charger 20, a register roller 21, a developing unit 22, and a sheet feed section 23.

In operation, an original document laid on the glass platen 4 is illuminated by the illuminating unit 11. Imagewise light reflected by the document is focused onto the drum 7 by way of the first mirror, 12, second mirror 14, third mirror 13, lens 8 and fourth mirror 1. As a result, a latent image is electrostatically formed on the drum 7. In this instance, the charge potential deposited in a non-image area of the drum 7 as distinguished from an image area has been removed by the eraser 5. The latent image is developed by the developing unit 22 to become a toner image. The toner image is transferred by the transfer charger 20 to a paper which is fed from the sheet feed section via the register roller 21, whereafter the paper is separated from the drum 7 by the separation charger 19. The paper carrying the toner image thereon is transported by the belt 18 to the fixing section 16 which includes a fixing roller and a pressing roller and further to the copy tray 17. After such image transfer, toner particles remaining on the drum 7 are removed by the cleaning unit 10 and, then, the whole drum surface is discharged by the lamp 9 to remove remaining charge.

Figure 2:
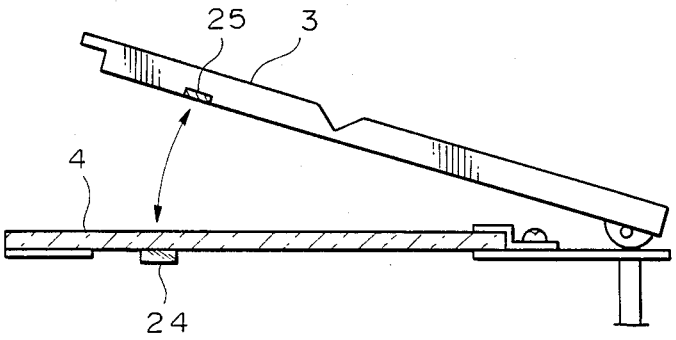
FIG. 2 is a schematic view of an arrangement for sensing an open and a closed position of a cover plate of the copier as shown in FIG. 1.

Referring to FIG. 2, an arrangement for sensing an open and a closed position of the cover plate 3 is shown. This arrangement includes a reed microswitch 24 which is mounted on the underside of the glass platen 4 outside of the non-image area, and a magnet 25 which is embedded in the cover plate 3 to face the microswitch 24 when the cover plate 3 is closed. The reed microswitch 24 is responsive to the open and closed positions of the cover plate 3. While the illustrative embodiment will be described in relation to the cover plate 3, it is of course applicable to an arrangement for sensing an open and a closed position of a substitute for the cover plate (belt transport section) of a transporting mechanism of an automatic document feeder (ADF).

Figure 3:
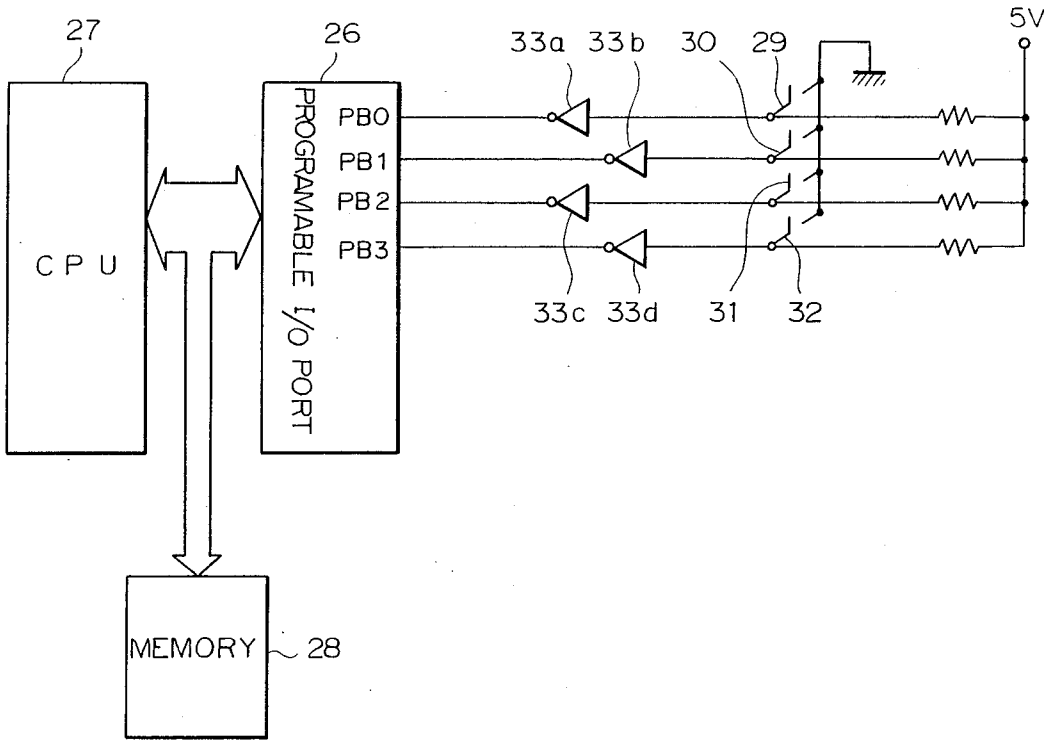
FIG. 3 is a block diagram schematically showing a circuit for sensing the open and closed positions of the cover plate.

A circuit for sensing the open and closed positions of the cover plate 3 is shown in FIG. 3. As shown, the circuit is made up of programable input/output (I/O) port 26, a central processing unit (CPU) 27, a memory 28, a switch 29 responsive to the open and closed positions of the cover plate 3, a dip switch 30, switches 31 and 32, and inverter integrated circuits (ICs) 33*a* to 33*d*. The programable I/O port (=8255) 26 is selectively switchable for input and output by a program. In this embodiment, since the inverter ICs 33*a* to 33*d* are fixed and preconditioned for input, the I/O port 26 is programed for input. When the cover plate 3 is closed, the switch 29 is opened so that the inverter 33*a* has a (logical) high level (=5 volts) and produces a (logical) low level output. Consequently, an input port PB0 has a low level. While the cover plate 3 is open, the switch 29 is closed so that the inverter 33*a* has a low level (=0 volt) and produces a high level output and, hence, the input port PB0 becomes a high level.

Figure 9:
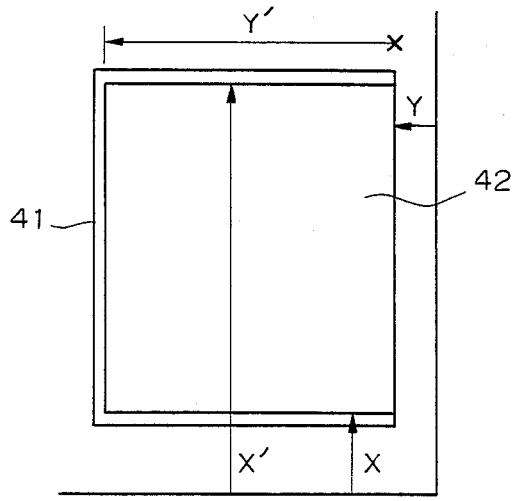
FIG. 9 is a diagram representative of a usual copy mode.

The dip switch 30 is adapted to inhibit the eraser turn-on control from being switched depending upon the position of the cover plate 3. Specifically, when the switch 30 is open, a port PB1 has a low level allowing the eraser turn-on control to be switched. Conversely, when the switch 30 is closed, the port PB1 has a high level inhibiting the eraser turn-on control from being switched. Such inhibition of switching of eraser turn-on control is oriented to a user who does not want the lines associated with the edges of a document (frame) to appear on a copy without exception. When the switching of eraser turn-on control is inhibited, a copy is always produced with the inner frame of a document erased, as shown in FIG. 9.

Figure 4:
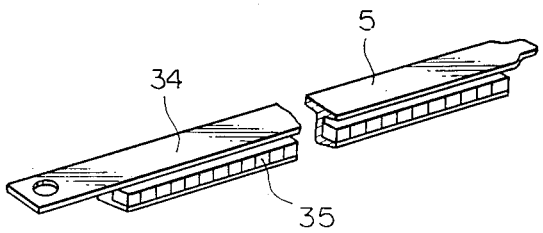
FIG. 4 is a schematic perspective view of an eraser.
Figure 5:
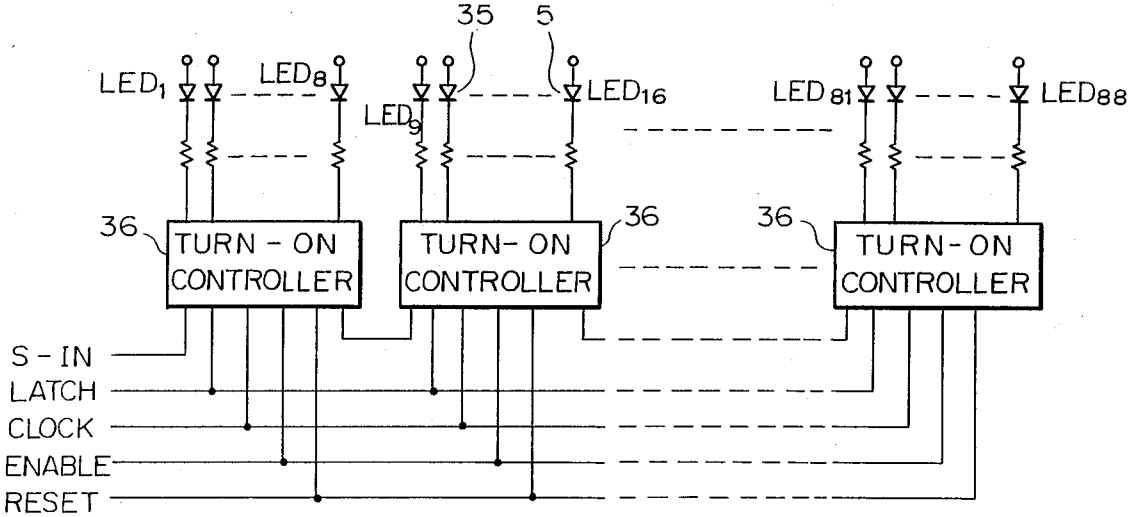
FIG. 5 is a schematic block diagram showing an array of light emitting elements.

Referring to FIG. 4, the eraser 5 is constituted by a PC substrate 34, and an array of numerous light emitting elements 35 which is arranged on the substrate 34 over the entire length of the drum 7. While the light emitting elements 35 in this embodiment are implemented by light emitting diodes (LED), they may alternatively be implemented by a neon tube, a FL tube or a tungsten lamp. It is to be noted that the eraser 5 may be located anywhere in the range between the charging and developing stations, i.e., whether it is located before or after the exposing station is not critical. In the illustrative embodiment, eighty-eight LEDs $LED_1$ to $LED_{88}$ are arranged on the substrate 34 at a pitch of 5 millimeters. As shown in FIG. 5, the LEDs $LED_1$ to $LED_{88}$ are divided into eleven blocks which are individually connected to eleven turn-on controllers 36 and individually turned on and off by a serial data input S-IN, a LATCH signal, a CLOCK signal, an ENABLE signal, and a RESET signal.

Figure 6:
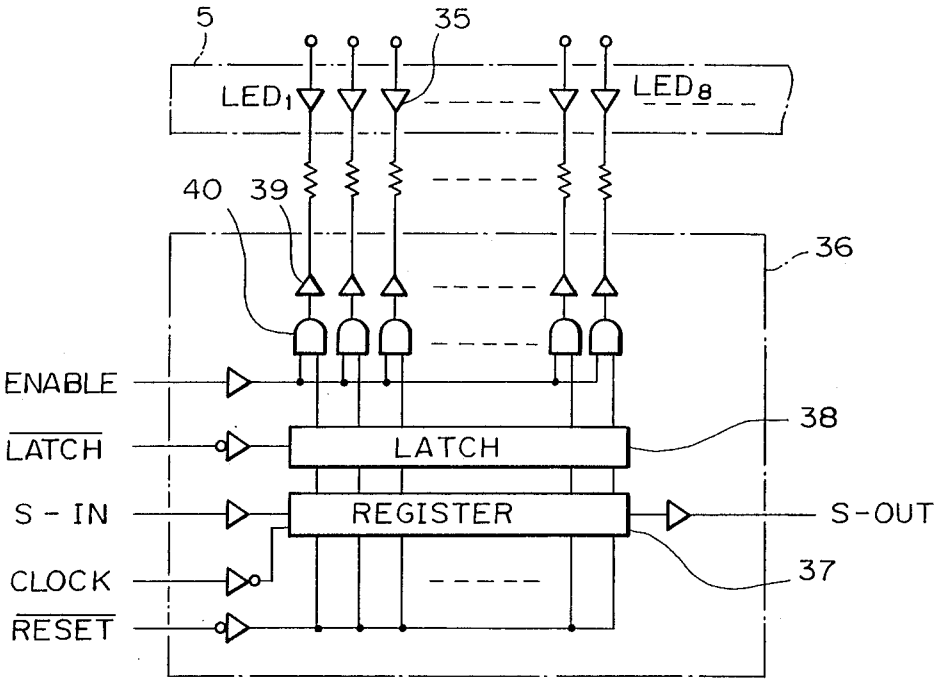
FIG. 6 is a block diagram schematically showing an eraser turn-on control circuit.

FIG. 6 shows a specific construction of each of the turn-on controllers 36. As shown, the turn-on controller 36 is made up of a shift register 37 having a D-type flip-flop configuration, a latch 38, and a driver 39. Applied to the shift register 37 are the CLOCK signal and serial data S-IN signal, applied to the latch 38 is the LATCH signal, and applied to the driver 39 via an AND gate 40 is the ENABLE signal.

Figure 7:
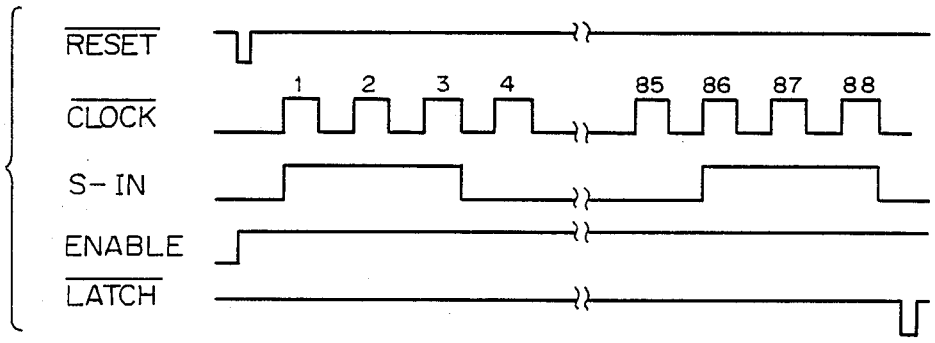
FIG. 7 is a timing chart representative of a relationship between control signals which are applied to the eraser.

Referring to FIG. 7, there is shown in a timing chart showing an exemplary relationship between the various control signals. In the illustrative embodiment, since eighty-eight LEDs $LED_1$ to $LED_{88}$ are used, eighty-eight serial data S-I signals are sequentially fed to the turn-on controllers 36 in synchronism with the CLOCK signal. After the delivery of eighty-eight data, the LATCH signal is turned into a low level to latch the eighty-eight data in the individual latches 38. In response to an ENABLE signal, particular ones of the drivers 39 are energized to turn on their associated LEDs for thereby effecting erasure. Afterwards, until the LATCH signal becomes a low level again, the LEDs are on/off controlled based on the data which were taken in by the previous low level of the LATCH signal.

Figure 8:
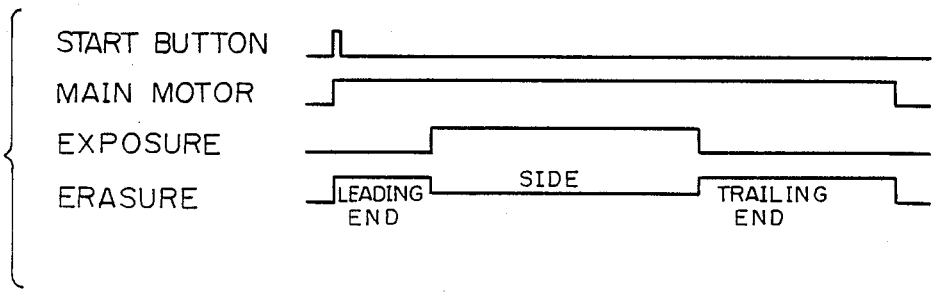
FIG. 8 is a timing chart demonstrating an erasing procedure.

As schematically shown in FIG. 8, the erasing procedure is such that after the start of a copying operation all the LEDs are turned on to effect leading end erasure, in an image area particular ones of the LEDs are turned on to effect side (opposite edges) erasure, and finally all the LEDs are turned on again to effect trailing end erasure.

Figure 10:
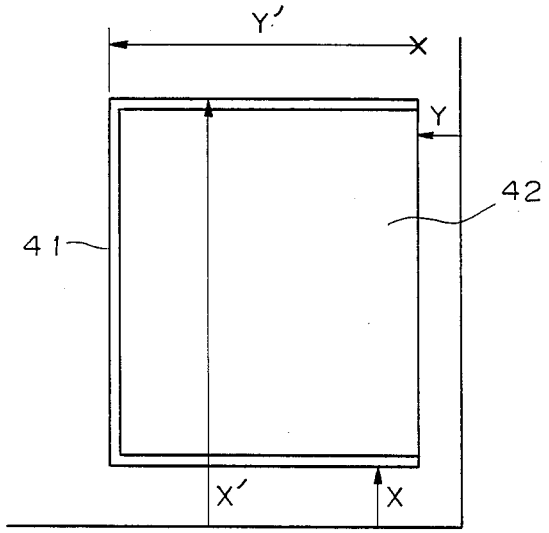
FIG. 10 is a view similar to FIG. 9, showing a full-surface copy mode.

While the switch 30 remains closed, the erasure turn-on control is inhibited, as stated earlier. In this condition, copies are always produced with the inner frame erased with no regard to the position of the cover plate 3, as shown in FIG. 9. In FIG. 9, the reference numerals 41 and 42 designate a paper and an image, respectively. As shown in FIGS. 9 and 10, the distance Y′ and the distance between X and X′ represent areas that are not erased by the LED's.

On the other hand, when the dip switch 30 is open and the cover plate 3 is closed, the dimensions X, X′ and Y′ shown in FIG. 9 are changed to those shown in FIG. 10 so that an image may be reproduced on the entire paper surface. Specifically, X and X′ are each representative of the value of side erasure and variable at the pitch of the LEDs, i.e. 5 millimeters. Since eighty-eight LEDs are used, each of X and X′ is implemented as an 8-bit (1 byte) memory. The number of LEDs to be turned on or off as counted from a reference position are stored in each of the 8-bit memories.

Figure 11:
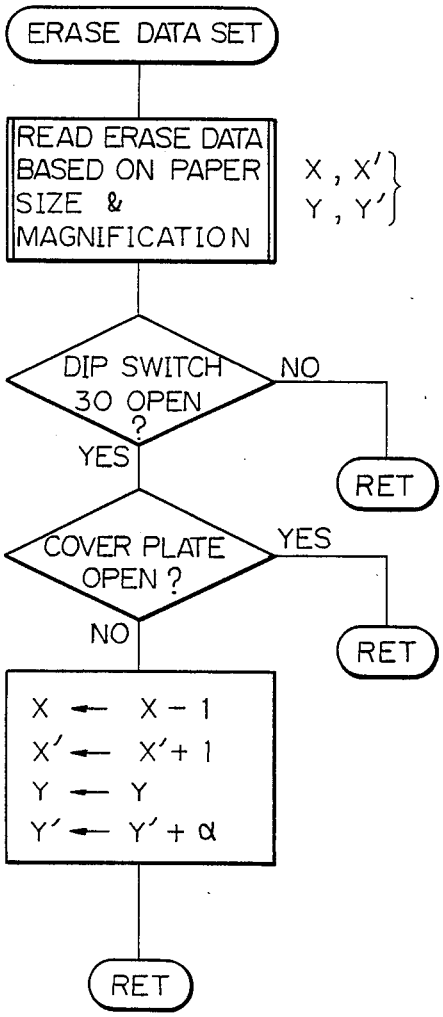
FIG. 11 is a flowchart demonstrating the full-surface copy mode operation.

The full surface image mode which occurs when the dip switch 30 is open and the cover plate 3 is closed as stated above will be described with reference to FIG. 11. In this mode, X is decreased by one while X′ is increased by one as represented by $X \leftarrow X-1$ and $X' \leftarrow X'+1$ in the figure. Y is representative of an interval between the time when a scanner moves away from a home sensor and the time when it reaches the leading end of an image. Further, Y′ is representative of an interval between the time when the scanner is located at the leading end of an image and the time when it reaches the trailing end of an image.

In the full surface image mode, the period of time Y′ is corrected such that the trailing end is shifted by 5 millimeters relative to that in the usual copy mode which is shown in FIG. 9. Here, Y and Y′ are each implemented with a 2-byte memory.

In summary, it will be seen that the present invention provides an eraser turn-on control device for a copier which prevents the outside of a document size from being imaged on a photoconductive element as a black portion. This eliminates wasteful consumption of toner while freeing a cleaning unit from the need for an excessive cleaning ability.

Various modifications will become possible for those skilled in the art after receiving the teachings of the present disclosure without departing from the scope thereof.

What is claimed is:

1. A photocopier machine comprising:

a platen for receiving an original document;

a cover plate for selectively covering said platen;

imaging means for imaging an image of said document;

a photoconductive element for receiving said image;

charging means for charging said photoconductive element;

developing means for developing the image formed on said photoconductive element;

an eraser for removing charges deposited on said photoconductive element which do not represent part of the image, said eraser being formed of a plurality of light emitting elements extending across the width of said photoconductive element; and control means for selectively actuating said light emitting elements of said eraser so as to selectively erase charges on the photoconductive element depending upon the position of said cover plate such that charges in an area of the photoconductive element corresponding to an area outside of the border of a paper sheet to which the developed image is transferred are erased when said cover plate is down, and that charges in an area of the photoconductive element corresponding to an area inside the border of the paper sheet are erased when said cover plate is up.

2. The photocopier machine as claimed in claim 1, further comprising inhibiting means for preventing said selective actuation of the light emitting elements of said eraser depending upon the position of said cover plate.

3. The photocopier machine as claimed in claim 1, further comprising a reed microswitch and a magnet placed on said platen and cover plate so as to determine the position of said cover plate, said microswitch being connected to said control means.

* * * * *